US006435282B1

(12) United States Patent
Robison et al.

(10) Patent No.: US 6,435,282 B1
(45) Date of Patent: Aug. 20, 2002

(54) ANNULAR FLOW SAFETY VALVE AND METHODS

(75) Inventors: Clark E. Robison, Tomball; Paul D. Ringgenberg, Spring, both of TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/690,767

(22) Filed: Oct. 17, 2000

(51) Int. Cl.[7] ..... E21B 34/10

(52) U.S. Cl. ..... 166/386; 166/66.7; 166/319; 166/332.1; 166/374

(58) Field of Search ..... 166/386, 374, 166/66.4, 66.6, 66.7, 319, 332.1, 330, 250.07

(56) References Cited

U.S. PATENT DOCUMENTS

| | | | | |
|---|---|---|---|---|
| 3,990,508 A | | 11/1976 | Boyadjieff | |
| 4,160,484 A | | 7/1979 | Watkins | |
| 4,372,392 A | | 2/1983 | Barrington | |
| 5,207,275 A | | 5/1993 | Stratton | |
| 5,211,243 A | | 5/1993 | Stratton | |
| 5,234,057 A | * | 8/1993 | Schultz et al. | 166/319 |
| 5,329,999 A | | 7/1994 | White | |
| 5,394,943 A | | 3/1995 | Harrington | |
| 5,564,502 A | | 10/1996 | Crow | |
| 5,810,083 A | | 9/1998 | Kilgore | |
| 6,079,497 A | | 6/2000 | Johnston | |
| 6,286,596 B1 | * | 9/2001 | Schnatzmeyer et al. | 166/250.15 |
| 6,318,457 B1 | * | 11/2001 | Den Boer et al. | 166/66.7 |

OTHER PUBLICATIONS

Halliburton; *Completion Products, Second Edition*; pp. 5–5 thru 5–9, 5–22.

* cited by examiner

*Primary Examiner*—David Bagnell
*Assistant Examiner*—Zakiya Walker
(74) *Attorney, Agent, or Firm*—William M. Imwalle; John F. Booth

(57) ABSTRACT

The present inventions contemplate improved annular flow safety valve apparatus and methods in which the valve comprises a bi-directional self-contained electromechanically operated valve assembly including a moveable seal, power source, electric motor, and control system, capable of operating with or without power or control inputs from the surface.

32 Claims, 3 Drawing Sheets

ANNULAR FLOW SAFETY VALVE AND METHODS

TECHNICAL FIELD

The present invention relates to new devices and methods used in providing an electromechanically operated annular flow safety valve in the tubing of a cased subterranean well.

BACKGROUND OF THE INVENTIONS

Safety valves are used in subterranean wells to prevent uncontrolled fluid flow, which if not controlled could lead to equipment damage or a catastrophic well blowout. Conventional safety valves generally use a flapper mechanism with a sealing member in the form of a circular disc. Such safety valves are typically constructed with a bias spring mechanism maintaining a closed position, and a hydraulically operated actuator for moving the sealing member to an opened position. Similar safety valves with ball closure mechanisms are also known in the art. It is generally known to control safety valves with a wireline connection to the surface. Some valves have also been designed to close in response to a predetermined pressure. Examples of prior art safety valves are disclosed in U.S. Pat. Nos. 3,990,508; 4,160,484; 4,372,392; and 6,079,497.

Problems exist with downhole safety valves known in the art. Wireline control connections and hydraulic pressure sensors both impose limits on the operating environment of common safety valves. Two of the most important limitations are that of depth and pressure. Physical control connections are more difficult to maintain with increasing depth. Likewise, hydraulic systems are more difficult to operate at the high pressures often found in deep wells. Physical control and sensor mechanisms also have the serious disadvantage that it is required to remove the valve from the well to change pre-selected actuation parameters. Flapper valves are further limited by their one-directional nature. Flapper valves and ball valves are both subject to corrosion from particles that are often found suspended in well fluids. There is a need for improved safety valves with increased flexibility in terms of operating environment and control parameters. There is also a need for safety valves that will undergo minimized erosion damage during use.

SUMMARY OF THE INVENTIONS

The present inventions contemplate improved annular flow safety valve apparatus and methods in which the valve comprises a bi-directional self-contained electromechanically operated valve assembly including a moveable seal, power source, electric motor, and control system. The improved safety valve is capable of operating with or without power or control inputs from the surface. Features are also provided to decrease the erosive effect of solids suspended in the fluid stream.

BRIEF DESCRIPTION OF THE DRAWINGS

The accompanying drawings are incorporated into and form a part of the specification to illustrate several examples of the present inventions. These drawings together with the description serve to explain the principles of the inventions. The drawings are only for the purpose of illustrating preferred and alternative examples of how the inventions can be made and used and are not to be construed as limiting the inventions to only the illustrated and described examples. The various advantages and features of the present inventions will be apparent from a consideration of the drawings in which.

DETAILED DESCRIPTION

Figure 1:
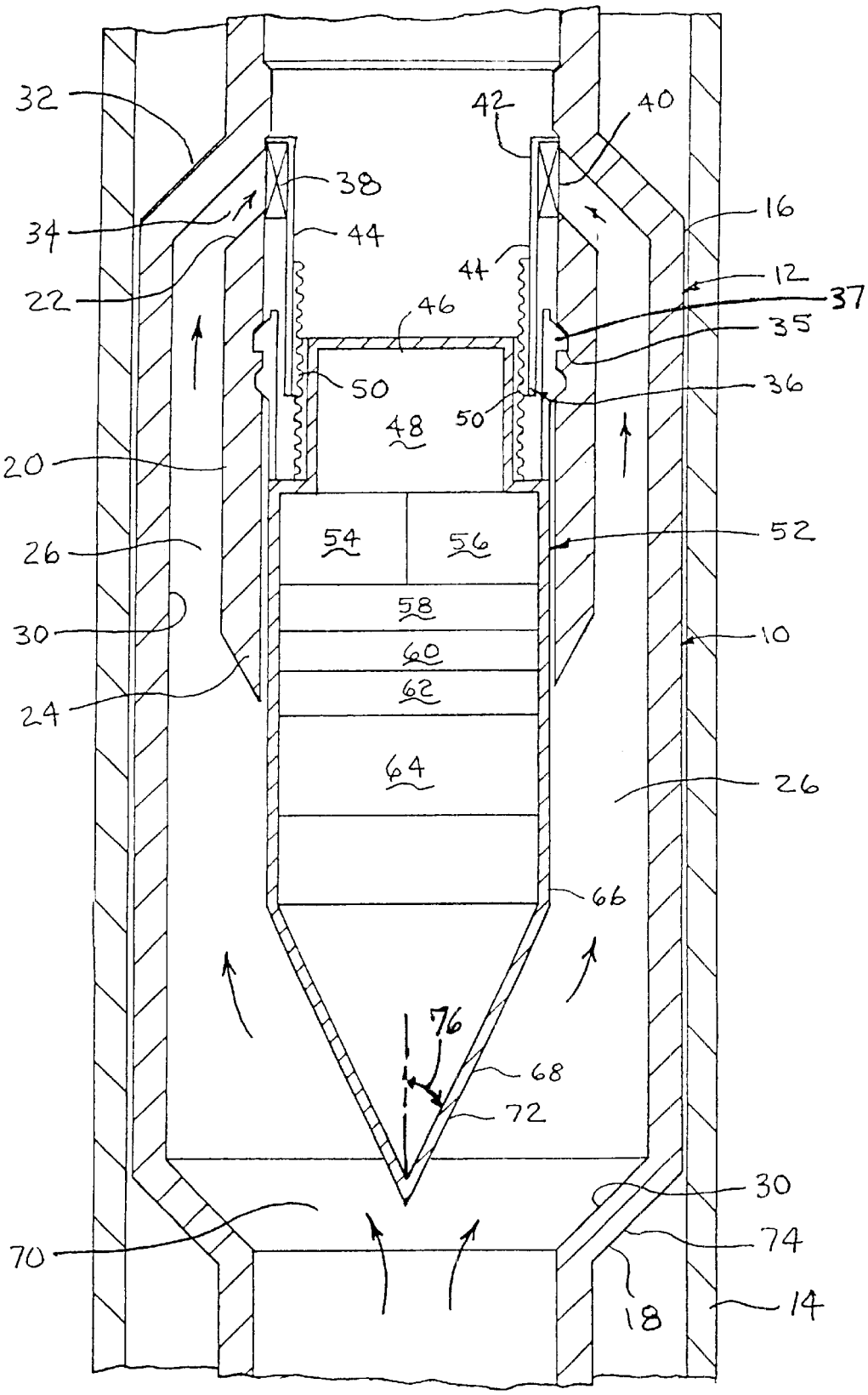
FIG. 1 is a longitudinal cross-sectional view of an annular flow safety valve apparatus in accordance with the inventions shown in the fully closed position.

The present inventions are described by reference to drawings showing one or more examples of how the inventions can be made and used. In these drawings, reference characters are used throughout the several views to indicate like or corresponding parts.

In the description which follows, like or corresponding parts are marked throughout the specification and drawings with the same reference numerals. The drawings are not necessarily to scale and the proportions of certain parts have been exaggerated to better illustrate details and features of the invention. In the following description, the terms "upper," "upward," "lower," "below," "downhole", "longitudinally" and the like, as used herein, shall mean in relation to the bottom, or furthest extent of the surrounding wellbore even though the wellbore or portions of it may be deviated or horizontal. Correspondingly, the "transverse" orientation shall mean the orientation perpendicular to the longitudinal orientation.

In the description of the inventions, some terms referring to various aspects of operation of the apparatus are used. The word "actuation" is used to mean to manipulate or change state. The term "self-contained" means an autonomous unit having all working parts except as specifically indicated. Where components of relatively well-known design are employed, their structure and operation will not be described in detail.

Figure 2:
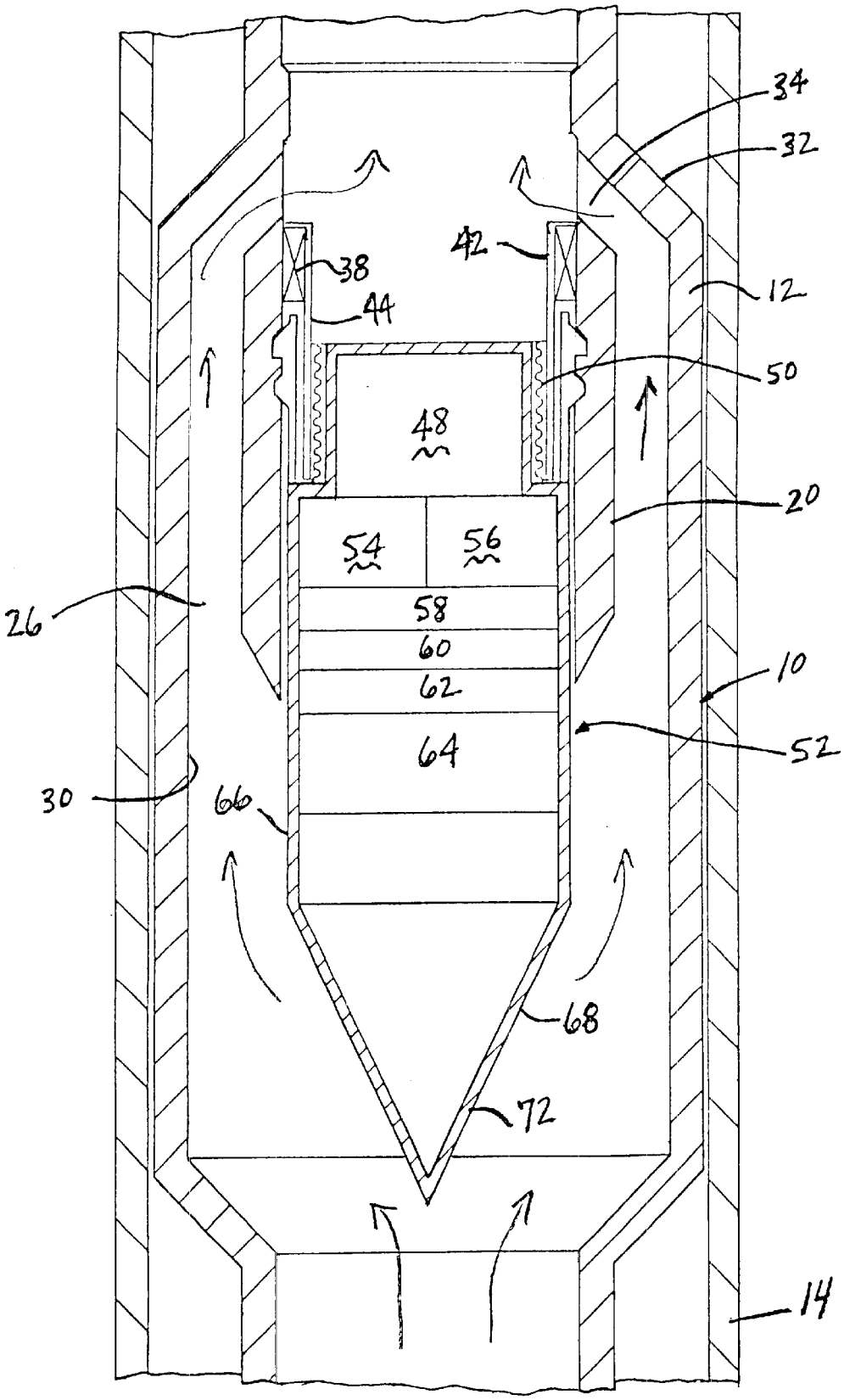
FIG. 2 is a longitudinal cross-sectional view of an annular flow safety valve apparatus in accordance with the inventions in the fully open position.

Referring now primarily to FIGS. 1 and 2, the general structure and operation of the annular flow safety valve apparatus 10 utilizing the present inventive concepts is shown. A substantially tubular outer housing 12 of a size to fit inside the well casing 14 is deployed therein. The outer housing 112 has an upper end 16 and a lower end 18. A nipple 20 is more or less concentrically disposed within the outer housing 12. The nipple 20 has an upper end 22 proximal to the upper end 16 of the outer housing 12, and extends in the direction of the lower end 18 of the outer housing 12, terminating in a lower end 24. A substantially annular fluid flow passage 26 is deformed between the outer surface 28 of the nipple 20 and the interior surface 30 of the outer housing 12. A narrowing portion 32 of the outer housing 12 directs fluid flow, shown by the arrows, toward a plurality of ports 34 provided around the annulus of the upper end 22 of the nipple 20.

The nipple has a lock mandrel seat 35 on the interior surface 28 of the nipple's upper end 22. A seal assembly 136 is disposed within the nipple 20 and may extend past the lower end 24 of the nipple. The seal assembly 36 has a lock mandrel 37 secured to the mandrel seat 35. The seal assembly 36 has a seal element 38, preferably surfaced with an elastomeric material 40. The seal element 38 is attached to the upper end 42 of a seal mandrel 44 moveable within a range between a fully closed position as shown in FIG. 1, and a fully opened position as shown in FIG. 2. In the fully closed position (FIG. 1), the seal element 38 prevents fluid flow through the annular passage 26 by completely obstructing the ports 34 at the upper end 22 of the nipple 20. In the fully opened position (FIG. 2), the seal element 38 does not obstruct the ports 34, permitting fluid to flow freely through the annular passage 26. The movement of the seal mandrel 44 is facilitated by an operable connection to a motor assembly 46 portion of the seal assembly 36. The motor assembly 46 has an electric motor 48 operably connected to the moveable seal mandrel 42, preferably with a ball screw mechanism 50.

Further referring primarily to FIGS. 1 and 2, an electronic control assembly 52 has a control circuit 54 electrically connected to the motor 48. The control circuit 54 preferably includes a microprocessor circuit 56 electrically connected to a telemetry circuit 58. The telemetry circuit 58 is preferably designed to monitor physical parameters such as for example, location, temperature, flow, and pressure, and may contain sensor apparatus 60 known in the arts. The control circuit 54 preferably also contains a receiver circuit 62 for receiving signals from remote locations such as the wellhead (not shown). The electric motor 48 and control circuit 54 components are electrically connected to a downhole power source 64, typically a storage battery. The motor assembly 46, control assembly 54, and power source 64 are preferably housed within an inner housing 66, situated inside the nipple 20, which includes a nosepiece 68 extending past the lower end 24 of the nipple. Optionally, the control assembly and power source may be located outside of the inner housing 66, for example at the wellhead (not shown), and connected to the motor assembly via wire line (not shown). A plurality of lower ports 70 are provided between the outer surface 72 of the nosepiece 68 and the inner surface 30 of the outer housing 12, which has a broadening portion 74 to facilitate fluid flow (indicated by the arrows) through the annular passage 26. The nosepiece 68 is elongated, with the elongation preferably determined by the geometric relationship of the inside diameter of the outer housing 12 and the nosepiece angle 76. It is known that a nosepiece angle 76 of approximately seven degrees provides favorable resistance to erosion by particles that may be suspended in the well fluid, such an angle is therefore preferred.

Figure 3:
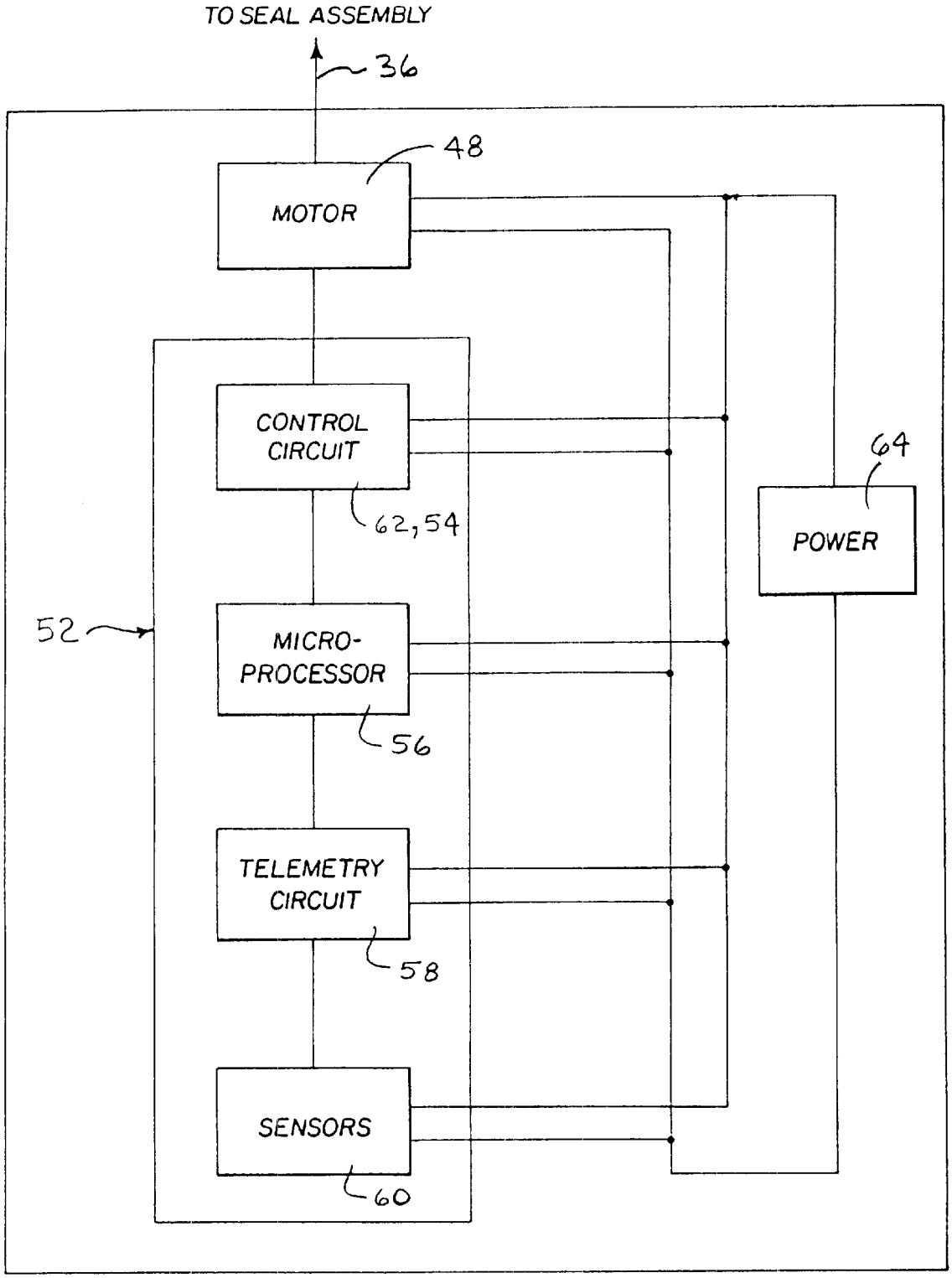
FIG. 3 is a schematic diagram of an example of a control assembly for an annular flow safety valve in accordance with the inventions.

With reference primarily to FIG. 3, a schematic example of the operation of the preferred embodiment of the control assembly 52 is more particularly described. The motor assembly 46 contains an electric motor 48 mechanically connected to the ball screw (numeral 50, FIGS. 1–2) of the annular flow safety valve apparatus 10 as follows. The control assembly 52 has a control circuit 54 electrically connected to the motor 48. The control circuit 54 preferably includes a microprocessor circuit 56 electrically connected to a telemetry circuit 58. The telemetry circuit 58 is designed to monitor physical phenomena such as for example, location, temperature, flow, and pressure, and may contain sensor apparatus 60 known in the arts such as quartz temperature and pressure transducers, for example. The electric motor 48 and control assembly 52 components are electrically connected to a downhole power source 64, preferably a storage battery.

Referring now to the above description and FIGS. 1–3 in general, some aspects and advantages of the operation of the invention are generally described. The motor assembly and control assembly of the invention are preferably self-contained so that the annular flow safety valve apparatus includes a moveable seal, power source, electric motor, and control assembly, capable of operating together in response to predetermined parameters without need of power or control inputs from the surface. For example, the control assembly may be preconfigured to position the seal in the fully open position while a particular telemetry signal, typically pressure, is received. Upon loss of the telemetry signal, the motor is actuated and the seal is moved to the fully closed position. In an alternative configuration, the control assembly may be preconfigured to position the translating seal in the fully closed position when a particular telemetry signal is not received, and to actuate the motor moving the translating seal to the fully open position when a particular telemetry signal is received. In still other configurations, the control assembly may be preconfigured to respond to various signals or combinations of signals from the sensor apparatus, such as changes in pressure or flow rate, opening or closing the seal according to predetermined parameters. The microprocessor circuit may be used to perform calculations or logical operations on selected parameters detected by the sensor apparatus, actuating the movement of the seal element according to predetermined factors. Additionally, the receiver circuit included in the control assembly may be used to receive a remote signal, facilitating manual operation of the annular flow safety valve apparatus at the discretion of an operator at the surface. The receiver circuit may also be used to receive a remote signal used to reconfigure the internal instructions and settings of the microprocessor circuit in a manner known in the arts, enabling in-place adjustments to the actuation parameters of the annular safety apparatus.

The embodiments shown and described above are only exemplary. Many details are often found in the art such as: control assembly configurations and circuitry and seal element or housing materials. Therefore, many such details are neither shown nor described. It is not claimed that all of the details, parts, elements, or steps described and shown were invented herein. Even though numerous characteristics and advantages of the present inventions have been set forth in the foregoing description, together with details of the structure and function of the inventions, the disclosure is illustrative only, and changes may be made in the detail, especially in matters of shape, size and arrangement of the parts within the principles of the inventions to the full extent indicated by the broad general meaning of the terms used in the attached claims.

The restrictive description and drawings of the specific examples above do not point out what an infringement of this patent would be, but are to provide at least one explanation of how to make and use the inventions. The limits of the inventions and the bounds of the patent protection are measured by and defined in the following claims.

What is claimed:

1. A safety valve for use in a subterranean well comprising:

a substantially tubular outer housing of a size to fit inside a well hole;

a nipple of a size to fit inside the outer housing such that an annular flow passage is defined between the nipple and the outer housing;

a seal assembly connected to the nipple, the seal assembly having a longitudinal seal mandrel and a seal element connected to the seal mandrel and movable between an open position wherein fluid is allowed to communicate through the annular flow passage, and a closed position wherein fluid communication through the annular flow passage is prevented; and an electronic control assembly operably connected to the seal assembly for actuating movement of the seal element between the open position and closed position.

2. A safety valve for use in a subterranean well according to claim 1 wherein the electronic control assembly further comprises a sensor for receiving an actuation signal and wherein the seal element is actuated to move between the open and closed positions in response to the actuation signal.

3. A safety valve as in claim 2 Wherein the sensor is a temperature sensor and wherein the actuation signal is a downhole temperature.

4. A safety valve as in claim 2 wherein the sensor is a pressure sensor and wherein the actuation signal is a downhole pressure.

5. A safety valve as in claim 2 wherein the sensor is a receiver and the actuation signal is an acoustic signal.

6. A safety valve for use in a subterranean well according to claim 1 wherein the electronic control assembly further comprises means for receiving a remote signal, means for storing actuation parameters for governing actuation of the seal element, and wherein the actuation parameters are changeable in response to the remote signal.

7. A safety valve as in claim 6 wherein the remote signal is transmitted from the surface.

8. A safety valve for use in a subterranean well according to claim 1 wherein the electronic control assembly further comprises a microprocessor circuit to facilitate actuation of the seal assembly according to preselected logical operations.

9. A safety valve as in claim 1 wherein the seal assembly further comprises: an electric motor operably connected to the seal element for moving the seal element between the open and closed positions.

10. A safety valve as in claim 1 wherein the nipple fits approximately concentrically within the outer housing.

11. A safety valve as in claim 1 wherein the seal assembly further comprises: a ball screw mechanism operably connected to the seal element to facilitate moving the seal element between the open and closed position.

12. A safety valve as in claim 1 wherein the seal assembly further comprises: an elongated nosepiece for reducing erosion of the safety valve.

13. A subterranean well comprising;

a well hole;

a substantially tubular outer housing disposed within the well hole;

a nipple disposed within the outer housing such that an annular flow passage is defined between the nipple and the outer housing;

a seal assembly connected to the nipple, the seal assembly having a longitudinal seal mandrel and a seal element connected to the seal mandrel and moveable between an open position wherein fluid is Wallowed to communicate through the annular flow passage and a closed position wherein fluid is prevented from communicating through the annular flow passage; and an electronic control assembly operably connected to the seal assembly for actuating movement of the seal element between the open and closed positions.

14. A subterranean well as in claim 13 wherein the well hole is cased.

15. A subterranean well as in claim 13 wherein the electronic control assembly further comprises:

a sensor for receiving an actuation signal and wherein the seal element is actuated to move between the open and closed positions in response to the actuation signal.

16. A subterranean well as in claim 15 wherein the electronic control assembly further comprises:

means for receiving a remote signal, means for storing actuation parameters for governing actuation of the seal element, and wherein the actuation parameters are changeable in response to the remote signal.

17. A subterranean well as in claim 13 wherein the electronic control assembly further comprises a microprocessor circuit to facilitate actuation of the seal assembly according to preselected logical operations.

18. A subterranean well as in claim 13 wherein the seal assembly further comprises a ball screw mechanism operably connected to the seal element to facilitate moving the seal element between the open and closed position.

19. A subterranean well as in claim 13 further comprising an elongated nosepiece for reducing erosion of the safety valve.

20. A method of controlling fluid flow through a subterranean wellbore comprising: positioning a safety valve assembly in the wellbore the safety valve having an outer housing, a nipple disposed within the outer housing such that annular flow passage is defined between the nipple and the outer housing, a seal assembly connected to the nipple, the seal assembly having a longitudinal seal mandrel and a seal element connected to the seal mandrel and moveable between an open position wherein fluid is allowed to communicate through the annular flow passage and a closed position wherein fluid is prevented from communicating through the annular flow passage; and actuating the safety valve assembly to move between an open and closed position thereby controlling fluid flow through the annular flow passage.

21. The method of claim 20 wherein the safety valve is actuated in response to the changes in pressure.

22. The method of claim 20 wherein the safety valve is actuated in response to a remote actuation signal.

23. A safety valve for use in a subterranean well for controlling axial flow within an annular flow passage, the valve comprising:

a substantially tubular outer housing;

a nipple of a size to fit inside the outer housing such that the annular flow passage is defined between the nipple and the outer housing;

a seal assembly connected to the nipple, the seal assembly having a seal mandrel movable between an open position wherein fluid is allowed to axially communicate along the annular flow passage and a closed position wherein fluid communication along the annular flow passage is prevented.

24. A safety valve as in claim 23 further comprising an electronic control assembly operably connected for actuating the seal assembly.

25. A safety valve as in claim 24 wherein the electronic control assembly further comprises a sensor for receiving an actuation signal and wherein the seal mandrel is actuated to move between the open and closed positions.

26. A safety valve as in claim 25 wherein the sensor is a pressure sensor and the actuation signal is a downhole pressure.

27. A safety valve as in claim 25 wherein the sensor is a receiver and the actuation signal is an acoustic signal.

28. A safety valve as in claim 24 wherein the electronic control assembly further comprises means for receiving a remote signal, means for storing actuation parameters for governing actuation of the seal mandrel, and wherein the actuation parameters are changeable in response to the remote signal.

29. A safety valve as in claim 24 wherein the electronic control assembly further comprises a microprocessor circuit to facilitate actuation of the seal assembly according to preselected logical operations.

30. A safety valve as in claim 23, the seal assembly further comprising a seal element connected to the seal mandrel.

31. A safety valve as in claim 23, the nipple having an elongated nosepiece for reducing erosion of the safety valve.

32. A safety valve as in claim 31, the nosepiece having a nosepiece angle of approximately seven degrees.

* * * * *